US008562088B2

(12) United States Patent
Lim et al.

(10) Patent No.: US 8,562,088 B2
(45) Date of Patent: Oct. 22, 2013

(54) REFRIGERATOR

(75) Inventors: Jae Hoon Lim, Suwon-si (KR); Jeong Man Nam, Gwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 188 days.

(21) Appl. No.: 12/585,892

(22) Filed: Sep. 28, 2009

(65) Prior Publication Data

US 2010/0090574 A1 Apr. 15, 2010

(30) Foreign Application Priority Data

Oct. 13, 2008 (KR) ..... 10-2008-100013

(51) Int. Cl.
*A47B 96/04* (2006.01)
*A47B 88/00* (2006.01)

(52) U.S. Cl.
USPC ..... 312/404; 312/402; 312/334.1

(58) Field of Classification Search
USPC ..... 312/334.6, 334.12, 334.15, 312/334.18–334.21, 334.25, 334.26, 312/334.33, 334.37, 334.39–334.43, 312/400–404, 330.1, 334.1
See application file for complete search history.

(56) References Cited

U.S. PATENT DOCUMENTS

| | | | | |
|---|---|---|---|---|
| 2,546,459 | A * | 3/1951 | Lee | 108/28 |
| 2,556,612 | A * | 6/1951 | Buntin | 312/334.12 |
| 2,630,364 | A * | 3/1953 | Gleason | 312/323 |
| 2,711,944 | A * | 6/1955 | Meek et al. | 312/333 |
| 2,843,441 | A * | 7/1958 | Jewell | 312/301 |
| 2,955,441 | A * | 10/1960 | Dahlgren et al. | 62/344 |
| 6,641,239 | B2 * | 11/2003 | Kaiser | 312/404 |
| 7,380,410 | B2 * | 6/2008 | Rand et al. | 62/302 |
| 7,712,852 | B2 * | 5/2010 | Choi et al. | 312/402 |
| 7,740,331 | B2 * | 6/2010 | Koo | 312/404 |
| 2005/0160854 | A1 * | 7/2005 | Rotter | 74/422 |
| 2006/0192469 | A1 * | 8/2006 | Koo | 312/330.1 |
| 2007/0018458 | A1 * | 1/2007 | Martinez | 290/53 |
| 2008/0203875 | A1 * | 8/2008 | Lim et al. | 312/404 |
| 2008/0203878 | A1 * | 8/2008 | Lim et al. | 312/405.1 |
| 2010/0219730 | A1 * | 9/2010 | Watts et al. | 312/404 |
| 2011/0006656 | A1 * | 1/2011 | Nam et al. | 312/404 |

FOREIGN PATENT DOCUMENTS

| | | |
|---|---|---|
| KR | 10-2006-0062149 | 6/2006 |
| KR | 10-2007-0019218 | 2/2007 |

* cited by examiner

*Primary Examiner* — Darnell Jayne
*Assistant Examiner* — Timothy M Ayres
(74) *Attorney, Agent, or Firm* — Staas & Halsey LLP

(57) ABSTRACT

A refrigerator having a storage box. The storage box may be configured to move back and forth in a storage compartment having a fixed rail. The storage box includes a guide unit provided at one side of the storage box, and a moving rail slidably coupled with the guide unit and accommodated in the fixed rail. The moving rail slidably moves back and forth along the fixed rail and the guide unit when the storage box moves back and forth. Since the guide unit is slidably coupled with the moving rail that moves back and forth along the fixed rail, a drawing length of the storage box is increased.

6 Claims, 7 Drawing Sheets

REFRIGERATOR

CROSS-REFERENCE TO RELATED APPLICATIONS

This application claims the benefit of Korean Patent Application No. 10-2008-0100013 filed on Oct. 13, 2008, in the Korean Intellectual Property Office, the disclosure of which is incorporated herein by reference.

BACKGROUND

1. Field

Embodiments of the present invention relate to a refrigerator. More particularly, embodiments of the present invention relate to a refrigerator capable of allowing a user to easily draw out a second storage box, which is a drawer type storage box installed on a first storage box in a freezing compartment.

2. Description of the Related Art

A refrigerator is an appliance that supplies cold air generated from a heat exchanger to a refrigerating compartment and a freezing compartment to keep freshness of various foodstuffs for a long period of time. In general, the refrigerator includes a storage compartment, which is divided into a refrigerating compartment and a freezing compartment, in a body that forms an external appearance of the refrigerator.

Recently, as the human life style improves, a refrigerator having a storage compartment, in which a refrigerating compartment storing beverages and foodstuffs for a short term is installed above a freezing compartment, has been increasingly used for convenience.

In such a refrigerator, a first storage box is installed in the freezing compartment to store foodstuffs to be kept in a freezing state. The first storage box is fixed to a rear surface of a freezing compartment door such that the first storage box can move back and forth like a drawer as the freezing compartment door is open or closed.

An additional storage box, that is, a second storage box is provided on the first storage box to store foodstuffs therein. However, a length of the second storage box exposed to the outside (hereinafter, referred to as a drawing length of the second storage box) is so short that the user cannot efficiently use the second storage box. Thus, it is necessary to increase the drawing length of the second storage box.

SUMMARY

Accordingly, it is an aspect of embodiments of the present invention to provide a refrigerator including a storage box capable of increasing a drawing length thereof.

Additional aspects and/or advantages will be set forth in part in the description which follows and, in part, will be apparent from the description, or may be learned by practice of the invention.

The foregoing and/or other aspects of embodiments of the present invention are achieved by providing a refrigerator including a storage compartment and a storage box configured to move back and forth in the storage compartment, wherein fixed rails are installed at an inner wall of the storage compartment, the storage box includes guide units provided on sides of the storage box, and moving rails slidably coupled with the guide unit and accommodated in the fixed rail, and the moving rails slidably move back and forth along the fixed rails and the guide units when the storage box moves back and forth.

The moving rail protrudes rearward from the storage box, so that a drawing length of the storage box is increased.

The guide unit and the moving rail include plastic products.

Guide units are provided at upper portions of both lateral sides of the storage box, and each moving rail is slidably coupled with an upper portion of one of the guide units.

A space bar is provided between the moving rails so that the moving rails are drawn by the same drawing length when the storage box moves back and forth.

According to another aspect, a refrigerator includes a storage compartment, a door installed to a front portion of the storage compartment, a first storage box, which moves back and forth like a drawer in cooperation with the door, and a second storage box installed on the first storage box and configured to move back and forth in the storage compartment, wherein fixed rails are installed at an inner wall of the storage compartment, the storage box includes guide units provided on sides of the storage box, and moving rails slidably coupled with the guide units and accommodated in the fixed rails, and the moving rails slidably move back and forth along the fixed rails and the guide units when the storage box moves back and forth.

A roller member is installed on one of the first and second storage boxes and a roller support is installed on remaining one of the first and second storage boxes. The roller member is loaded on the roller support, and the roller support guides sliding movement of the roller member when the second storage box moves back and forth.

As described above, guide units formed in the second storage box are slidably coupled with moving rails, and fixed rails are provided at both inner sidewalls of the storage compartment while surrounding the moving rails, so that the second storage box can be drawn out in the forward direction in a maximum range.

The fixed rails may provide a first drawing length and the moving rails may provide a second drawing length, wherein the second storage box may be fully extended to a combined length of the first drawing length summed with the second drawing length.

According to another aspect, a storage apparatus for use in a refrigerator may include a plurality of fixed rails, a storage compartment having an inner wall where the fixed rails are installed, a door installed to a front portion of the storage compartment, a first storage box, which moves in cooperation with the door, and a second storage box having guide units and moving rails slidably coupled with the guide units and accommodated in at least two of the plurality of fixed rails, allowing the second storage box to slidably move back and forth along at least two fixed rails and the guide units.

The second storage box may rest upon the first storage box.

The first storage box may have sliding rail units provided along a direction of movement of the first storage box and roller supports provided above the sliding rail units.

The second storage box may further have roller members fitting into the roller supports.

The guide units may be grooves protruding upward from the second storage box.

The moving rails may be coupled to the guide units through contacting the top surface and lateral sides of the guide units.

The plurality of fixed rails may provide a first drawing length and the moving rails may provide a second drawing length, wherein the second storage box may be fully extended to a combined length of the first drawing length summed with the second drawing length.

A stopper may be provided on each one of the plurality of fixed rails to stop movement of the second storage box along the at least two fixed rails upon drawing out the second storage box to a maximum drawing length of the at least two fixed rails.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
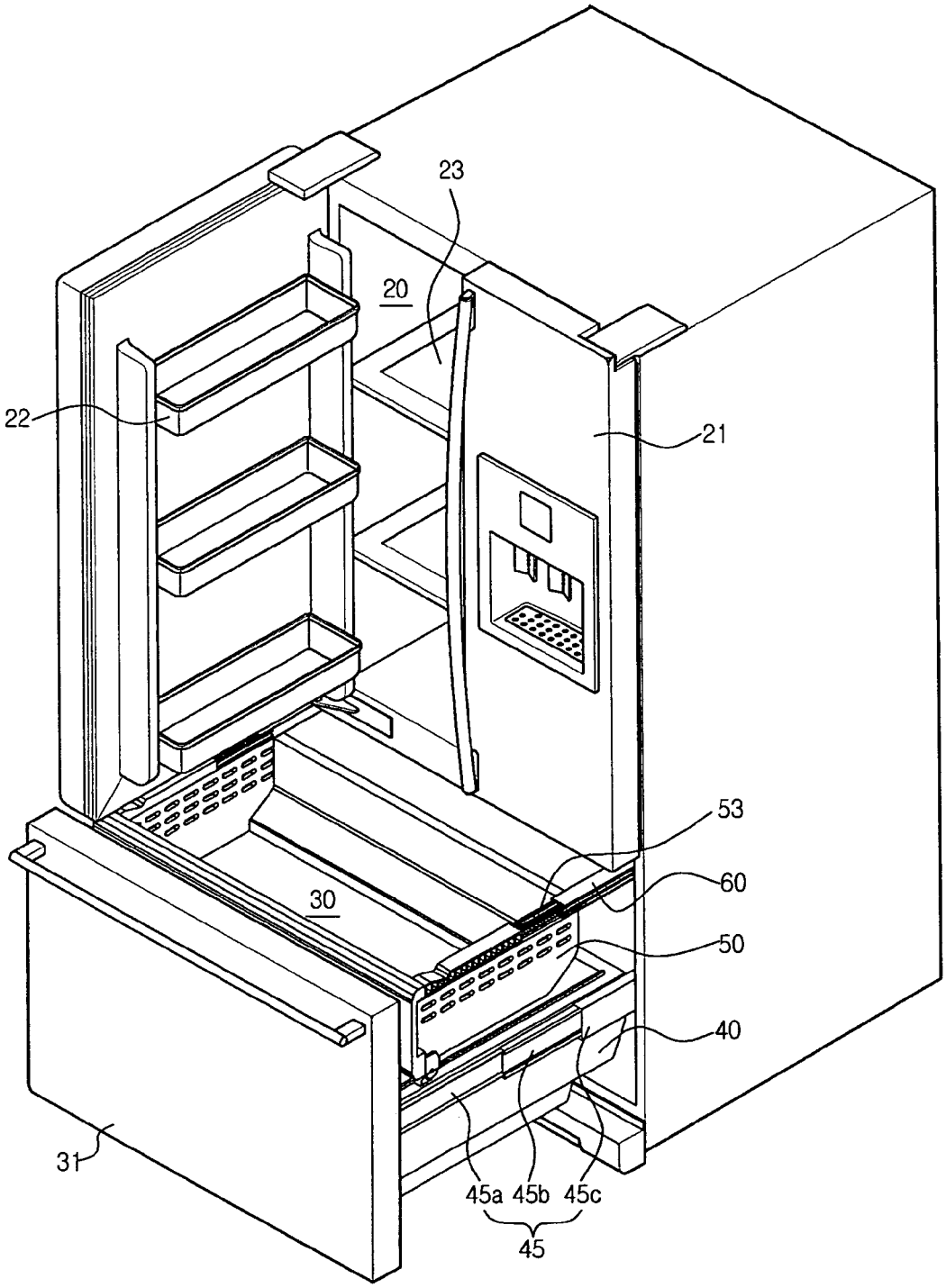
FIG. 1 illustrates a perspective view of a refrigerator according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Figure 2:
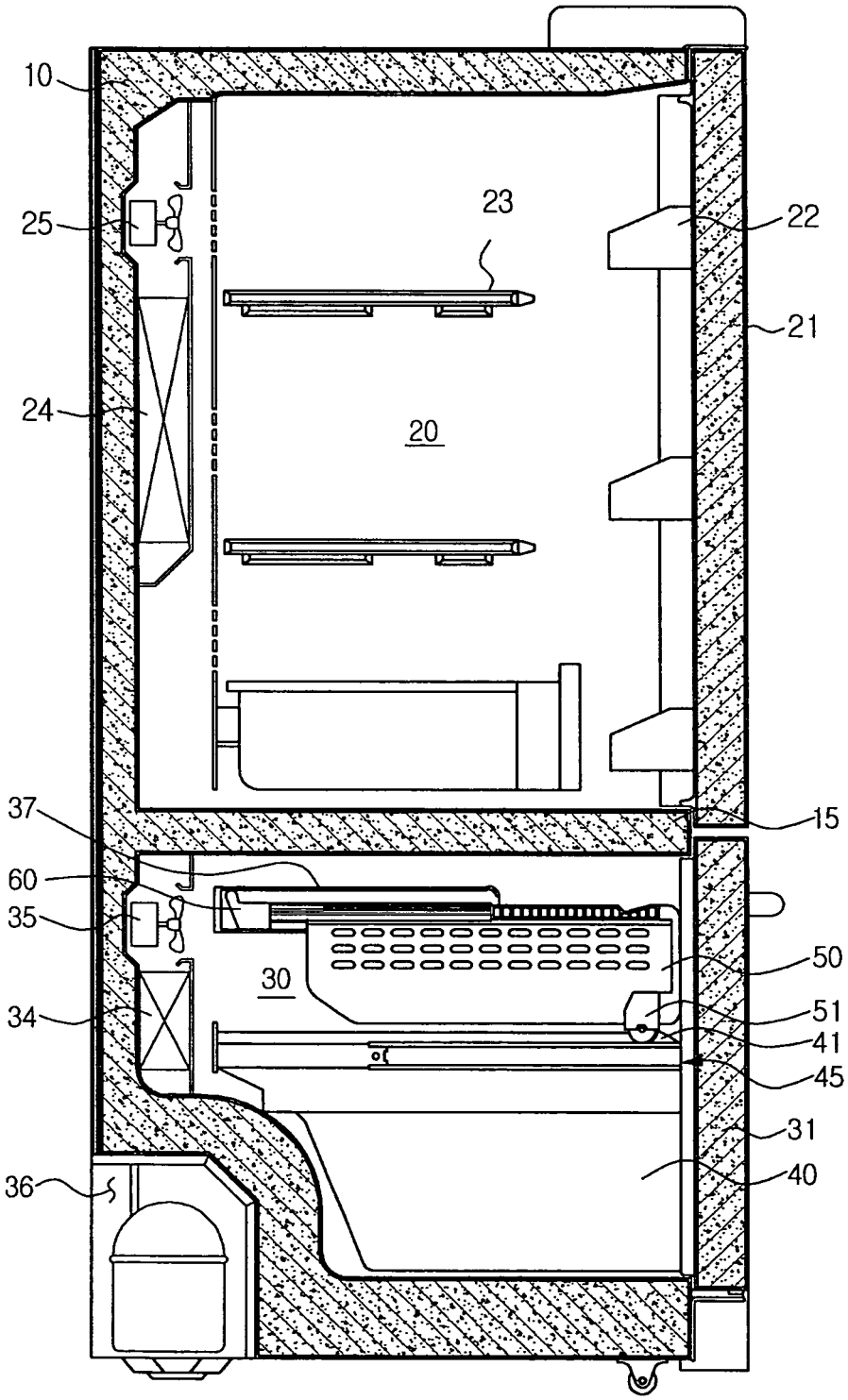
FIG. 2 illustrates a sectional view of the refrigerator shown in FIG. 1.

Referring to FIGS. 1 and 2, a refrigerator according to an embodiment of the present invention includes a body 10 that forms an external appearance of the refrigerator and a storage compartment is formed in the body 10. The storage compartment is divided into upper and lower parts by a partition wall 15. The upper part serves as a refrigerating compartment 20 and the lower part serves as a freezing compartment 30.

Heat exchangers 24 and 34 and blowing fans 25 and 35 are installed at rear portions of the refrigerating compartment 20 and the freezing compartment 30, respectively, in order to generate cold air and supply the cold air into the refrigerating compartment 20 and the freezing compartment 30. In addition, a machine room 36 is formed at a rear lower portion of the body 10. A compressor and a condenser are installed in the machine room 36. The compressor compresses refrigerant and the condenser condenses the compressed refrigerant, so that the condensed refrigerant is supplied to the heat exchangers 24 and 34.

Double door 21 and door 31 may be installed to front portions of the refrigerating and freezing compartments 20 and 30, respectively, in order to open/close the refrigerating and freezing compartments 20 and 30. The double door 21 installed to the refrigerating compartment 20 includes two doors rotatably open and close about left and right portions, respectively, of the refrigerating compartment 20, and the door 31 installed to the freezing compartment 30 is a drawer type door that moves back and forth.

A plurality of guards 22 may be installed at a rear surface of the double door 21 of the refrigerating compartment 20 in a multi-step structure. In addition, a plurality of shelves 23, drawers, and receptacles having basket shapes may be installed in the refrigerating compartment 20.

A first storage box 40 may be provided in the freezing compartment 30. The first storage box 40 is fixed to a rear surface of the freezing compartment door 31 and moves back and forth like a drawer when the freezing compartment door 31 is opened or closed.

Sliding rail units 45 may be provided between both lateral sides of the first storage box 40 and both inner sidewalls of the freezing compartment 30 in order to allow the first storage box 40 to move back and forth. The sliding rail unit 45 may include a first rail 45*a* fixed to both lateral sides of the first storage box 40, a third rail 45*c* fixed to both inner sidewalls of the freezing compartment 30, and a second rail 45*b* interconnecting the first and third rails.

An additional storage box, that is, a second storage box 50 may be disposed above the first storage box 40 in the freezing compartment 30. Roller members 51 may be provided at lower ends of both sides of the second storage box 50, and roller supports 41 are provided on the top surface of the first storage box 40. The roller members 51 may be loaded on the roller supports 41 to support the second storage box 50, and the roller supports 41 support the sliding movement of the roller members 51 when the second storage box 50 moves back and forth by a moving rail 60 and guide units 53 with guidance from fixed rails 37, which will be described later.

Figure 3A:
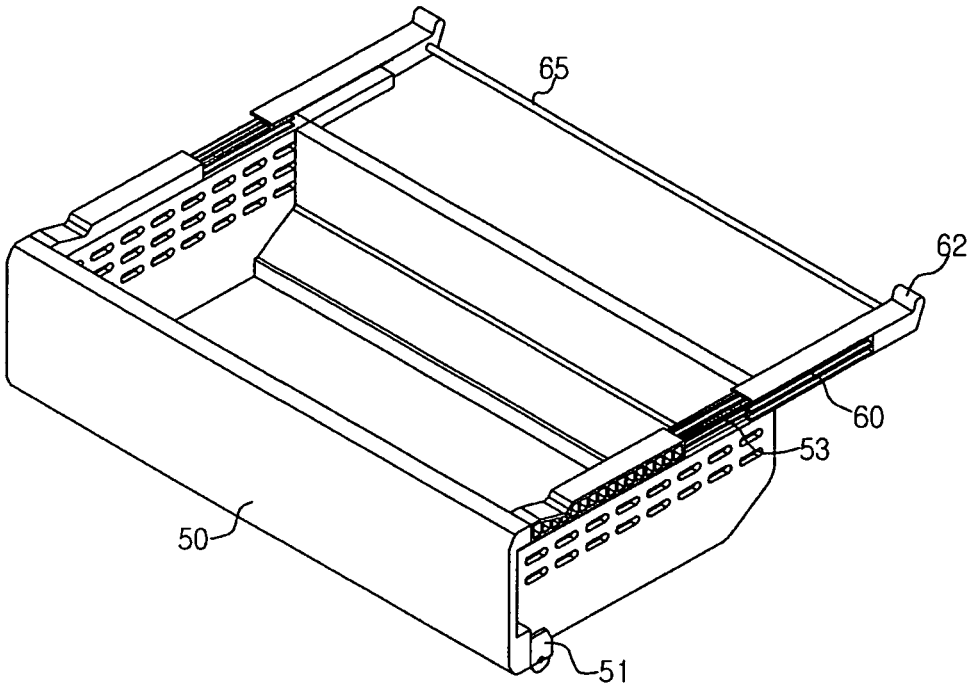
FIG. 3A illustrates a perspective view of a second storage box with roller members, and assembled with a sliding member.
Figure 3B:
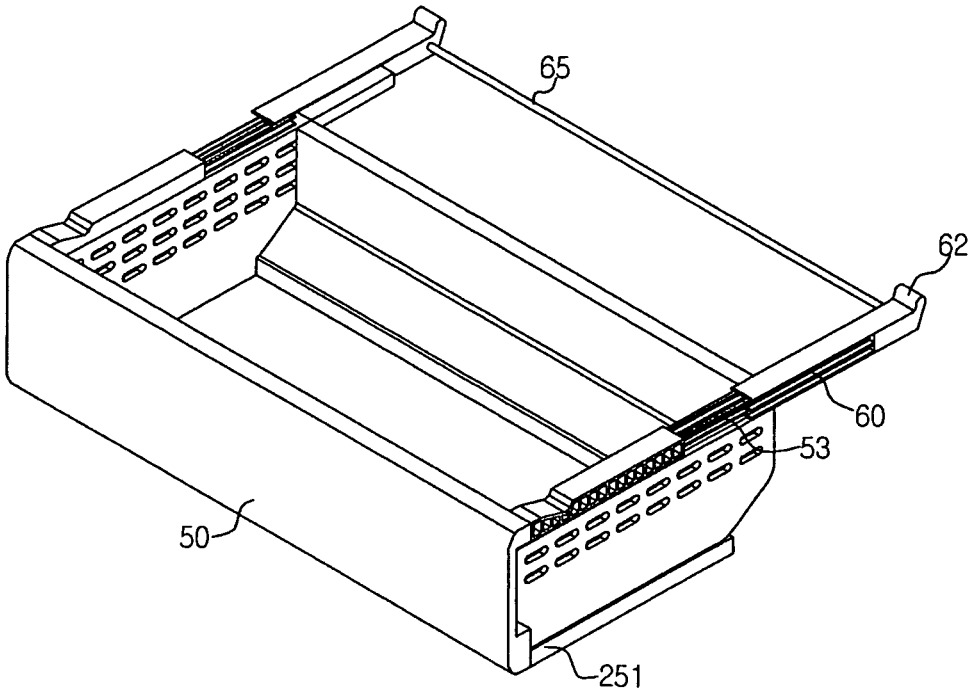
FIG. 3B illustrates a perspective view of a second storage box with roller supports, and assembled with a sliding member.

As shown in FIG. 3B, the roller supports 251 may be installed at lower ends of both sides of the second storage box 50 and the roller members can be mounted on the top surface of the first storage box 40 (not shown).

Figure 4:
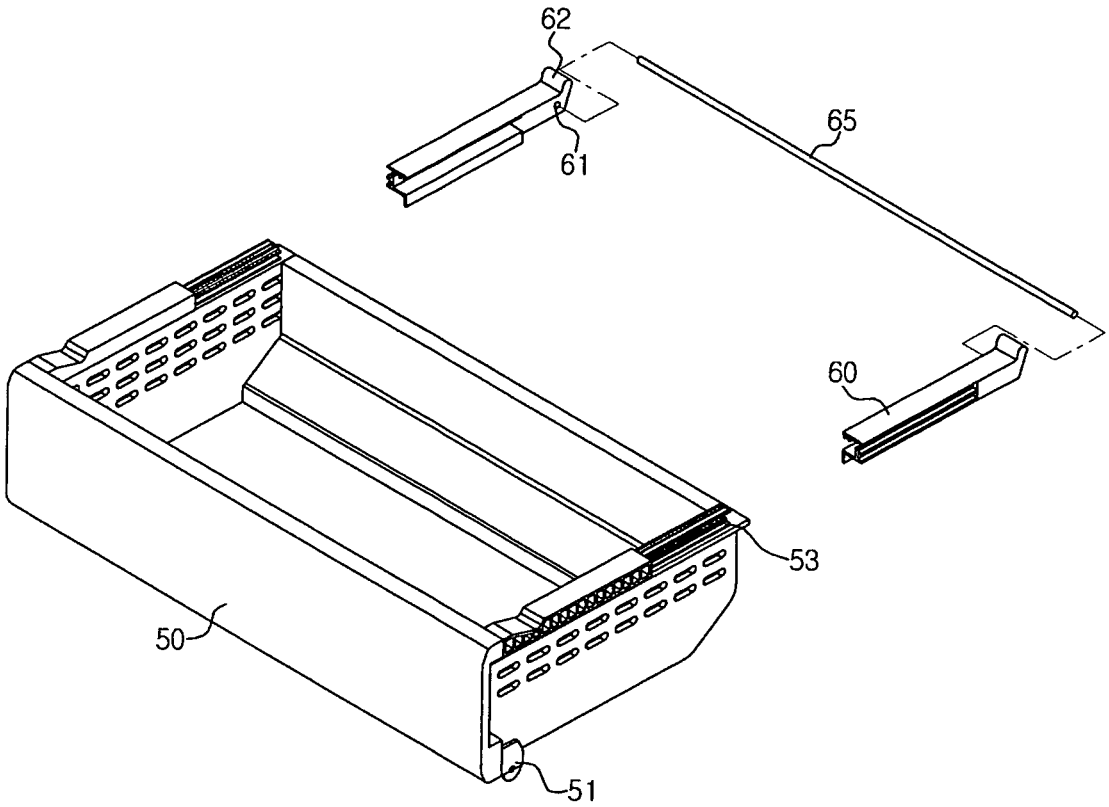
FIG. 4 illustrates an exploded perspective view of a second storage box and a sliding member illustrated in FIG. 3A.

As shown in FIGS. 3A, and 4, guide units 53 are provided at upper portions of both lateral sides of the second storage box 50. The guide units 53 may be guide grooves or guide protrusions protruding upward from the second storage box 50 (see, FIG. 5).

In addition, moving rails 60 with protrusions 62, are provided at upper portions of both lateral sides of the second storage box 50 in such a manner that the moving rails 60 are slidably coupled with the guide units 53. Each moving rail 60 makes contact with the top surface and lateral sides of the guide unit 53. The moving rail 60, which is slidably coupled with the guide unit 53, has height and width corresponding to those of the lateral side of the second storage box 50.

The moving rail 60 protrudes rearward from the second storage box 50 such that the drawing length of the second storage box 50 can be increased when the second storage box 50 is drawn out to the exterior.

According to an embodiment of the present invention, the guide unit 53 and the moving rail 60 are made from plastic. In this case, the guide unit 53 and the moving rail 60 may not deteriorate the aesthetic appearance of the second storage box 50 when the second storage box 50 is drawn out to the exterior.

As shown in FIGS. 3A, and 4, a space bar 65 is connected between the moving rails 60 and insertion holes 61 are formed in the moving rails 60 to fixedly install the space bar 65 between the moving rails 60.

The space bar 65 allows the second storage box 50 to easily move back and forth by regulating the sliding distance of each guide unit 53 relative to the moving rail 60.

That is, the sliding distance of the guide unit 53 relative to the moving rail 60 at one side of the second storage box 50 may not excessively deviate from the sliding distance of the guide unit 53 relative to the moving rail 60 at the other side of the second storage box 50 due to the space bar 65.

Further, since the space bar 65 is connected between the moving rails 60, fluctuation of the second storage box 50 in the moving direction can be minimized when the second storage box 60 moves back and forth.

Figure 5:
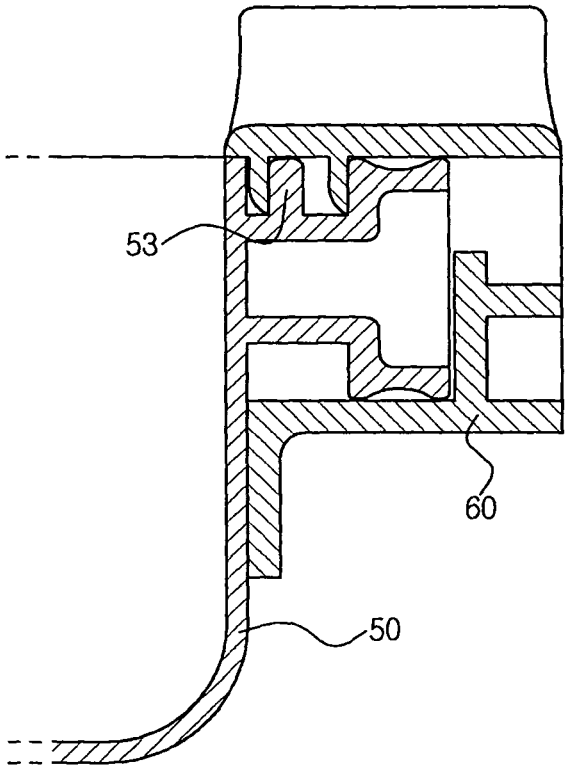
FIG. 5 illustrates a sectional view of a second storage box and a sliding member illustrated in FIG. 3A.

As shown in FIG. 5, the moving rail 60 may be slidably coupled with the guide unit 53, and makes contact with the top surface and lateral sides of the guide unit 53. Each moving rail 60 can be formed with a guide protrusion or a guide groove, which is coupled with the guide groove or the guide protrusion of the guide unit 53.

Figure 6:
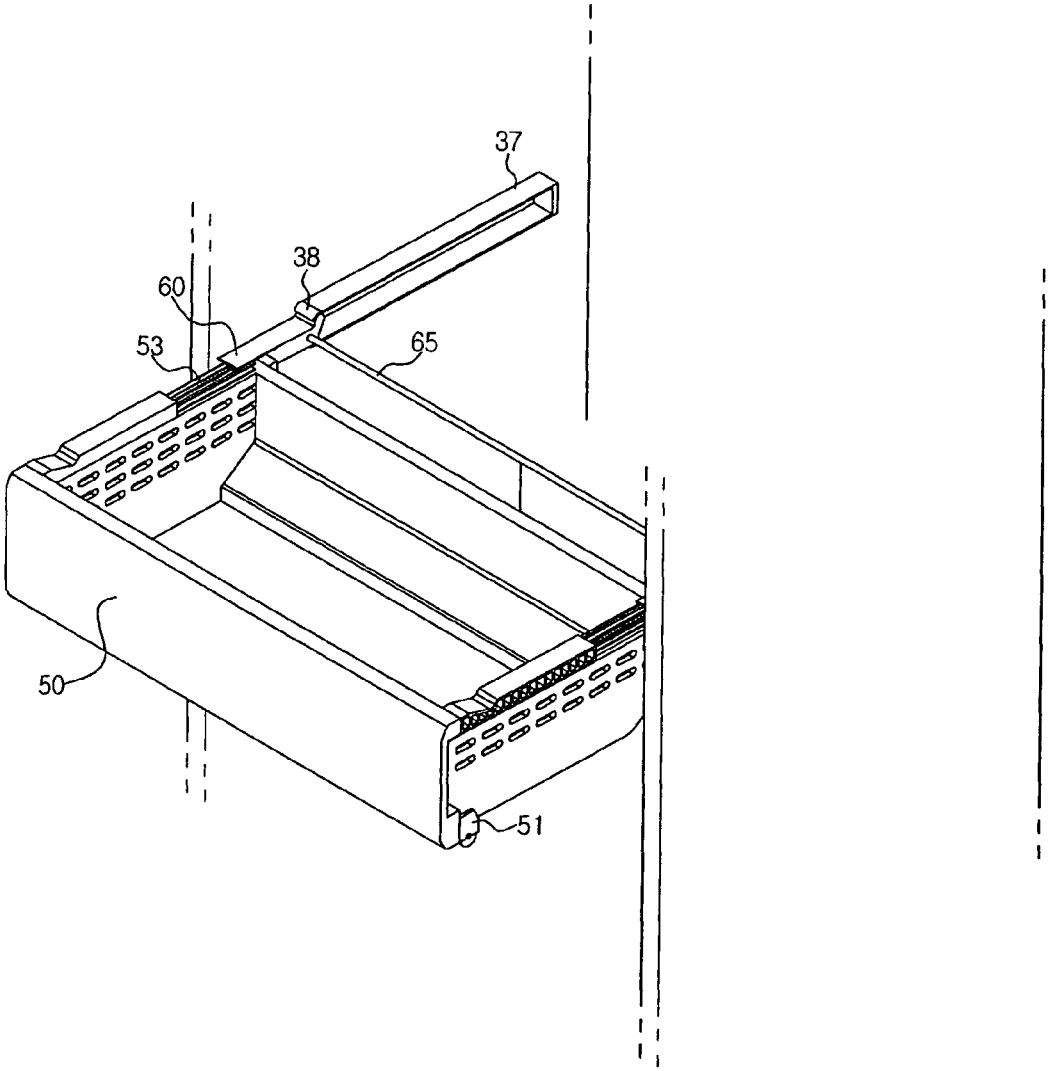
FIG. 6 illustrates a perspective view of a second storage box of FIG. 3A which is drawn out from a refrigerator.

As shown in FIG. 6, fixed rails 37 may be installed at both inner sidewalls of the freezing compartment 30 (FIG. 2). The fixed rails 37 surround the lateral sides of the second storage box 50 and the moving rails 60 to guide the movement of the second storage box 50 and the moving rails 60. That is, the fixed rails 37 guide the movement of the second storage box 50 and the moving rails 60 such that the second storage box 50 can be drawn in the forward direction in a maximum range.

The fixed rails 37 are provided at front portions thereof with stoppers 38, which restrict the movement of the moving rails 60 such that the moving rail 60 may not be excessively drawn out. In addition, the moving rails 60 are provided at rear ends thereof with protrusions 62 (FIG. 3A), which protrude upward from the moving rails 60, such that the protrusions 62 (FIG. 3A) make contact with the stopper 38 when the moving rails 60 are excessively drawn out.

Hereinafter, the procedure for drawing out the second storage box 50 according to an embodiment of the present invention will be described.

According to embodiments of the present invention, referring to FIGS. 2, 3A, and 6 in order to draw out the second storage box 50, the first storage box 40 must be primarily drawn out by pulling the freezing compartment door 31 in the forward direction. At this time, the first storage box 40 is drawn out through the sliding rail units 45 installed at both lateral sides of the first storage box 40 and both inner sidewalls of the freezing compartment 30.

In a state in which the first storage box 40 has been drawn out, if the user pulls the second storage box 50 in the forward direction, the second storage box 50 and the moving rail 60 move along the fixed rails 37 installed at both inner sidewalls of the freezing compartment 30, so that the second storage box 50 is drawn out to the outside.

At this time, if the second storage box 50 moves forward by a predetermined range, the protrusions 62 provided in the moving rails 60 make contact with the stoppers 38 provided in the fixed rails 37, so that the movement of the moving rails 60 is restricted. In this state, if the user further pulls the second storage box 50 in the forward direction, the guide units 53 provided in the second storage box 50 slidably move in the forward direction along the moving rails 60.

The guide units 53 provided in the second storage box 50 are slidably coupled with the moving rails 60 and the fixed rails 37 are installed at both inner sidewalls of the freezing compartment 30 to receive the moving rails 60 therein, so that the second storage box 50 can be drawn out in the forward direction in a maximum range.

As mentioned above, according to embodiments of the present invention, the second storage box 50 can be drawn out in the forward direction to a maximum range due to the moving rails 60 protruding rearward from the second storage box 50 and the fixing rails 37. Accordingly, the manufacturing cost can be reduced with embodiments of the present invention, as compared to the conventional refrigerator equipped with a sliding rail device.

In addition, according to embodiments of the present invention, the guide units 53 and the moving rails 60 are made from plastic, so that the aesthetic appearance of the second storage box 50 can be improved when the second storage box 50 is exposed to the outside.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a compartment;

a storage unit provided in the compartment, the storage unit configured to move back and forth in the compartment;

fixed rails installed at the inner wall of the compartment, the fixed rails being installed at right and left inner walls of the compartment, and each of the fixed rails including a guide recess, guide units integrally formed on the storage unit, the guide units being provided at top portions of both lateral sides of the storage unit, the guide units comprising a guide groove having an upward protruding protrusion formed in the guide groove; and moving rails coupled with the guide units, respectively, and accommodated in the guide recess of the fixed rails, the moving rails moving back and forth along the guide units when a drawing length of the storage unit is increased, the moving rails comprising a downwardly opening channel to accommodate the upward protruding protrusion formed in the guide groove, wherein the fixed rails receive the moving rails and guide a forward and rearward movement of the moving rails, and wherein a space bar is provided between the moving rails so that the moving rails are drawn by a same drawing length when the storage unit moves back and forth.

2. The refrigerator as claimed in claim 1, wherein the guide units and the moving rails are made of plastic products.

3. A refrigerator comprising:

a storage compartment;

a door installed to a front portion of the storage compartment;

a storage box configured to move back and forth in the storage compartment;

fixed rails installed at an inner wall of the storage compartment, the fixed rails being installed at right and left inner walls of the storage compartment, and each of the fixed rails including a guide recess;

guide units are formed on the storage box, the guide units being provided at top portions of both lateral sides of the storage box, the guide units comprising a guide groove having an upward protruding protrusion formed in the guide groove; and moving rails coupled with the guide units, respectively, and accommodated in the guide recess of the fixed rails, the moving rails moving back and forth along the fixed rails when a drawing length of the storage box is increased, the moving rails comprising a downwardly opening channel to accommodate the upward protruding protrusion formed in the guide groove, wherein the fixed rails receive the moving rails and guide a forward and rearward movement of the moving rails, wherein the fixed rails provide a first drawing length and the moving rails provide a second drawing length, and wherein the storage box is fully extended to a combined length of the first drawing length summed with the second drawing length.

4. The refrigerator as claimed in claim 3, wherein a space bar is provided between the moving rails so that the moving rails are drawn by a same drawing length when the storage box moves back and forth.

5. The refrigerator as claimed in claim 3, wherein the moving rails are coupled to the guide units through contacting the top surface and lateral sides of the guide units.

6. The refrigerator as claimed in claim 3, wherein the fixed rails each include a stopper provided at a first part thereof to stop movement along a guide unit of the storage box when the moving rails meet the stopper during drawing of the storage box.

* * * * *